US005163614A

United States Patent [19]

Tamás et al.

[11] Patent Number: 5,163,614

[45] Date of Patent: Nov. 17, 1992

[54] RAILWAY ROADBEDS WITH RAIL SLABS, AND METHOD FOR PREPARING

[75] Inventors: László Tamás; Zsolt Paapenek; Attila Komáromy; István Várszegi; Antal Tápai; Józaef Kókai; Adrián Horváth, all of Budapest; László Farkas, Solymár; Jenő Fülöp, Budapest; András Piller, Budapest; István Dombi, Budapest, all of Hungary

[73] Assignee: Beton-és Vasbetonipari Művek, Budapest, Hungary

[21] Appl. No.: 668,743

[22] Filed: Mar. 13, 1991

Related U.S. Application Data

[63] Continuation of Ser. No. 356,890, May 24, 1989, abandoned.

[30] Foreign Application Priority Data

Jun. 3, 1988 [HU] Hungary ..... 2903/88

[51] Int. Cl.[5] ..... F01B 1/00

[52] U.S. Cl. ..... 238/2; 238/382

[58] Field of Search ..... 238/2, 3, 5, 7, 8, 9, 238/382, 6

[56] References Cited

U.S. PATENT DOCUMENTS

| | | | |
|---|---|---|---|
| 775,486 | 11/1904 | Wolf | 238/9 |
| 1,171,441 | 2/1916 | Innes | 238/9 |
| 1,702,841 | 2/1929 | Ruping | 238/2 |
| 3,656,690 | 4/1972 | Hanig | 238/2 |
| 3,756,507 | 9/1973 | Hanig et al. | 238/2 |
| 4,232,823 | 11/1980 | Eggerman | 238/2 |

FOREIGN PATENT DOCUMENTS

| | | | |
|---|---|---|---|
| 1935531 | 10/1970 | Fed. Rep. of Germany . | |
| 2039033 | 2/1972 | Fed. Rep. of Germany | 238/2 |
| 2306428 | 9/1973 | Fed. Rep. of Germany | 238/2 |
| 3144608 | 5/1983 | Fed. Rep. of Germany | 238/2 |

*Primary Examiner*—Robert J. Oberleitner
*Assistant Examiner*—Mark T. Le
*Attorney, Agent, or Firm*—Schweitzer Cornman & Gross

[57] ABSTRACT

A railroad bed and method for making, wherein a less compact asphalt layer is spread on top of a more compact one, a trough shaped ballast bedding element suitably of reinforced concrete is placed over the aforementioned asphalt layers, a slab bearing the rails is applied into the trough-shaped ballast bedding, and an elastic, plastic-modified bituminous mortar is injected into the space between the slab and the ballast bedding element.

11 Claims, 2 Drawing Sheets

RAILWAY ROADBEDS WITH RAIL SLABS, AND METHOD FOR PREPARING

This is a continuing application of U.S. Ser. No. 356,890, filed May 24, 1989, now abandoned.

FIELD OF THE INVENTION

The invention relates to an arrangement for the complex formation of permanent ways and the method for preparing a proper railroad ballast by using large slabs.

BACKGROUND OF THE INVENTION

The positioning of filled section rails, particularly in the case of urban railways, is carried out so that rails are elastically placed into concrete roadway elements with troughs so that on the bottom surface of the cross section of rail channels that are widening downwards, the rails are laid onto elastic strips. The sides of the rails ar fixed by a profiled rubber band inserted between the inner walls of the rail channels and the sides of the rail.

A rail system is described in Hungarian patent No. 175,446, in which rails with trough are formed as filled section rails in which the encompassing cross section is a square, when one disregards the rail foot and the trough. Rail channels have a symmetrical trapezoidal cross section. One shorter surface of the profiled rubber band is pressed against the shoulder formed on the foot of the filled section rail, while one of its longer sides is pressed against the side wall of the aforementioned filled section rail, the other of its longer sides against the wall of the rail trough that has a slanted trapezoidal cross section.

This arrangement has a number of advantages, because during the construction of the track, screwed joints that require a considerable effort for maintenance, can be omitted and the trough between the elements made of reinforced concrete elements and the rail becomes no longer necessary.

A further advantage is in that by the application of the aforementioned patent construction and maintenance of the track can be performed quickly, without the laying of a bypass rail and the railway bed can also be used as a road for street traffic, and the building of the track can be accomplished without diverting road traffic, and correction of the lay of rails can be performed by the use of track-slabs.

The prior art has the unfavorable feature, that noiseless running of trains cannot be achieved, furthermore the harmful property has been found that at the meeting point of the slabs the relatively only slightly stiff filled section rail becomes frequently deformed and this results in the fracture of the filled section rail.

A different direction of development is disclosed in Federal German patent No. 1,935,531, which describes a rail track supporting slab. In this case the foot of the rail that is disposed on the sole plate fitting to the horizontal bottom of the rail track, is maintained in it position by elastically fixed clamping means on both sides.

The disadvantage of that solution is that the metallic connection does not enable quiet running of trains, and also slab deformation of ends of the track supporting panels of level crossings of the rails occurs increasingly, because the patent does not suggest any measures for the cooperation of the panels.

DESCRIPTION OF THE INVENTION

The aim of the invention is to develop an arrangement for the complex construction of railway superstructure with large slabs and their ideal bedding which is free form the aforementioned disadvantages of the prior art and by the aid of which deformation of slab ends and their uneven subsidence can be eliminated. The invention also aims at providing an intermediate piece that is protected from rain and is adopted to carry ducts of public works, covered by two slabs containing rails and by the central element arranged between them.

A further aim of the invention is effectively to reduce noise and vibration effects to such an extend that the noise of the railway bed should not exceed the noise from the passing of the train.

In accordance with the invention the foregoing aim is achieved with an arrangement in which the slabs are arranged in the embedding or ballast elements and suitably a polymer-modified bituminous elastic mortar is introduced between the ballast elements and the ballast elements are disposed on a loose embedding asphalt spread onto a compacted asphalt layer, wherein half of each slab overlaps half of the ballast element for a staggered relative arrangement.

Suitably ribs are formed in the vicinity of the two sides of the ballast element that run parallel to the axis of the rails and a console is formed adjacent to at least one of the ribs.

Suitably an adhesion preventing membrane is attached to the ballast elements.

It is also considered to be of advantage to provide the slabs with injecting bores. The structural elements suitably contain reinforcements of ductile iron.

We found that certain significant defects of large slab, multi-track rail systems with full section rails for urban electric tramways can be eliminated by inserting a bedding trough element and laying it so that the mid point of the length of each slab coincides with one of the two ends of each ballast element to obtain a stable base by the aid of which deformation and sinking of slab ends can be avoided and the cooperation of the panels can be achieved. After accurate adjustment with the screws in the slabs, the fixation of the exact level can be achieved by the aid of the material injected between the slabs. The elasticity and vibration damping effect of the material injected between the two slabs, greatly reduces the acoustic and vibration effects that harmfully affect the environment.

Thus, the arrangement of the rail track system with large slabs into the bedding rough also provides protection against acoustic and vibration effects.

The manifold requirements to be met by the railway bed slabs do not enable formation of the slabs, which could prevent direct propagation of noise by impairing that propagation. The keeping radiated noise at a low level can be achieved by reducing excitation of the vibration of the slabs.

Keeping the frequency of vibration of the concrete slabs at a low level can be accomplished by the fastening and supporting rubber bands used in the attaching of the rails, as well as with the large mass concrete ballast or bedding trough that, from an oscillation technological point of view is closely attached to the slab of the railway, through an elastic coupling having a high loss.

The solid cross section rail track system of the present invention prevents independent vibration of the slabs of the rail bed by means of the elastic ballast of high loss. The fixing rubber elements and the bedding mass which from the point of view of the vibration has a high loss factor and is coupled to three independent elastic elements, the mass being that of the concrete trough, and vibration screening effect of the concrete trough assure that only relatively low energy oscillations are transferred to the soil.

The oscillation energy propagated through the soil and transferred between the reinforced concrete trough and the soil, depends from the quality and specific impedance of the soil. By use of the present invention dynamic loads reaching the soil can be kept at a low value while assuring high quality of materials and construction.

Noise output radiated into the air can also be kept at a low level. Acoustic energy radiated by the tram during the passing thereof determines noise level, the noise level of the railway bed manifests itself only after the train has passed, and this level does not reach that of the noise level caused by the passing train. Considering that the structure of the railway bed assures long term good quality, a desired extent of protection against noise and oscillations is also assured.

DESCRIPTION OF THE DRAWING

A preferred embodiment of the present invention is described in detail with reference to the drawing, wherein.

DESCRIPTION OF A PREFERRED EMBODIMENT

Figure 1:
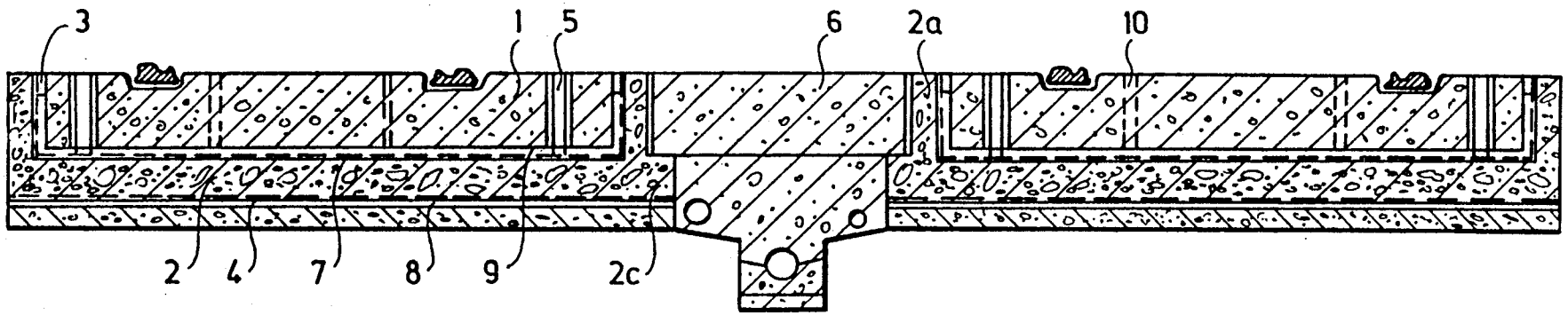
FIG. 1 is a cross section of a large, slab filled section rail.
Figure 2:
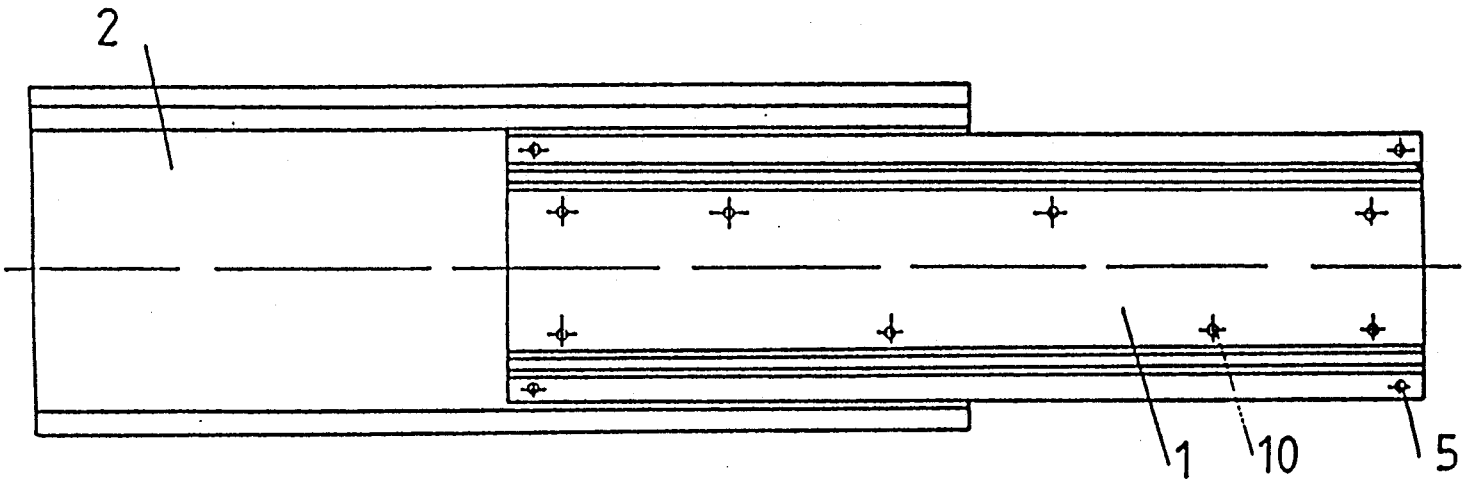
FIG. 2 shows a large view of the overlapping arrangement between the slab and ballast element.

FIG. 1 shows a slab 1 of reinforced concrete that is known per se, is arranged in a U-shaped bedding or ballast element 2. The ballast element 2 is disposed over embedding asphalt 8. An elastic mortar 9 is injected between the ballast element 2 and the slab 1. The mortar is suitably a polymer modified bitumen. The slab 1 is suitably provided with injection bores 10 for receiving the injected material and increasing the efficiency of the injection procedure.

A compact asphalt layer 11 is disposed below the embedding asphalt layer 8 to assure proper support. An adhesion preventing 4 is attached to the surface of the ballast element 2. The slabs 1 are displaced in an overlapping relationship over the ballast elements 2, so that the mid-point of the length of each slab is aligned with one of the two ends of a ballast element. The other end of the same ballast element is aligned with the mid point in the length of another slab.

A prefabricated reinforced concrete centerpiece 6 that is known per se is disposed between the railway beds with two tracks. The centerpiece 6 is supported by lateral ribs formed in the ballast element 2. An absorption system for water drainage, and current conductors and can be located below the center piece 6.

The ballast element 2 and the new railway bed element of reduced dimensions can be statically dimensioned and made of ductile steel reinforced concrete. Fixation of the rail is performed in a manner known from large slab rail systems in that for placing the filled section rail 12 is attached to a rubber plate, and rubber bands are arranged on both sides in longitudinal direction in the trapezoidally shaped trough 14.

Longitudinal and transverse gaps of the railway slab sealed by casting into them in the customary manner to prevent precipitation from running below the slabs 1.

Since accumulated deformation of the filled section rail 12 and resulting fracture are caused by the slabs 1 being laid onto a ballast bed that is not sufficiently rigid, the slabs can vertically tilt due to their symmetric (longitudinal) loading. Rigidity of the filled section rail is insufficient to take up the forces required to prevent relative displacement of two opposing ends of the two adjacent slabs 1. Rubber strips disposed in the gap between two slabs for attaching the filled section rails in the slab 1 do not provide any support for the filled section rails.

Reinforcement of the filled section rail is generally not practical, and is practically impossible to do in a section, (i.e. in the gaps between the slabs 1) as tilting motion of the slabs 1 has to be prevented by stiffening the ballast itself or at least by keeping it below a strictly limited value.

The ballast element 2 was developed to eliminate the foregoing drawbacks. Relative displacement of adjacent ends of the slabs 1 can be practically be prevented by "bonding" the ballast element 2 with the slab 1. The filler inserted between the slab 1 and the ballast element 2, which meets oscillation damping requirements, has a good effect on the vibration and noise levels of the rail bed. A further advantage is presented by the fact that the slab 1, the ballast element 2, can be statically considered as structurally cooperating elements and that results in that the ballast elements 2 need not be prestressed, ductile steel concrete reinforced is sufficient. Consideration of cooperation of the structures enables reduction of the dimensions of the slabs resulting in considerable savings in materials.

A rib **2*a* of the ballast element 2 is provided for various purposes. Most frequently the load on the slab 1 is when the load is from the rails, the ballast bed with the increased moment of inertia takes significant loading; and when the ballast element 2 is moved its rigidity is increased, it receives some of the elastic mortar 9 and prevents lateral flow losses by the use of a filler 3. A cantilever extension 2*c* supports the center piece 6** enabling laying of ducts of public works supplies and various cables.

Levelling bolts 5 enable installation of the slab 1 in compliance with the requirements for construction of railway beds.

The position of the slabs 1 within the system can be adjusted with a hoist, suitably with a hydraulic crane. In this case the slab 1 is suspended from a cross beam and is adjusted according to its desired position. The elastic mortar 9 is injected under the placed slab 1, the membranes 4 and 7 prevent adhesion between the slab 1 and the ballast bed 2, or the ballast bed 2 and embedding asphalt 8, respectively.

We claim:

1. A method for preparing a railway roadbed, comprising providing a first compact asphalt layer, providing a second asphalt layer on said first asphalt layer, said second asphalt layer being less compact than said first asphalt layer, providing at least one ballast element on said second asphalt layer, providing at least one rail supporting slab on said at least one ballast element, each said slab having a length and each said ballast element having two ends, arranging each said slab on each said ballast element in an overlapping manner so that the mid-point of said length of each said slab is substantially aligned with one of the two ends of each said ballast element, and injecting a polymer-modified bitumen mortar between said slab and said ballast element.

2. The method of claim 1, further comprising providing vertical ribs along each said ballast element to define a trough between said ribs.

3. The method of claim 2, further comprising providing a horizontal cantilever element adjacent one of said ribs, and forming said ballast element from concrete with reinforcement.

4. The method of claim 3, further comprising applying an adhesion-preventing membrane to a surface of said ballast element.

5. The method of claim 1, further comprising providing a plurality of bores in each said slab for receiving said mortar.

6. The method of claim 3, further comprising forming said reinforcement from ductile steel.

7. A railway roadbed, comprising a first compact asphalt layer, a second asphalt layer arranged on said first asphalt layer, said second asphalt layer being less compact than said first asphalt layer, a plurality of trough-shaped ballast elements arranged on said second asphalt layer, a plurality of rail supporting slabs each arranged in a partial overlap over two of said ballast elements, each said slab having a length and each said ballast element having two ends, each said slab being positioned over one each said ballast element so that the mid-point of said length of each said slab is substantially aligned with one of the two ends of each said ballast element, and an elastic mortar disposed between said slab and said ballast.

8. The railway roadbed of claim 7, wherein each said ballast elements is made from reinforced concrete and includes vertical ribs defining a trough between said ribs, each said ballast element also including a horizontal cantilever element adjacent at least one of said ribs.

9. The railway roadbed of claim 8, further comprising: each said ballast element including said ribs defining two troughs each of which receives a rail supporting slab, and a center-piece positioned between said two troughs and supported by said horizontal cantilever element.

10. The railway roadbed of claim 9, wherein each said rail supporting slab includes a plurality of bores for receiving said mortar, and each said ballast element includes an adhesion-preventing membrane on a surface of each said ballast element.

11. The railway roadbed of claim 7, wherein said elastic mortar is a polymer-modified bitumen mortar injected between said slab and said ballast element.

* * * * *